US007607642B2

(12) United States Patent
Kim

(10) Patent No.: US 7,607,642 B2
(45) Date of Patent: Oct. 27, 2009

(54) AIR DISCHARGE VALVE FOR A BEDCLOTHES COMPRESSING-AND-STORING BAG

(76) Inventor: Myung-soo Kim, 4-1009 Kukdong Apt., 271-3 Hagye 2-dong, Nowon-Ku, Seoul (KR)

( * ) Notice: Subject to any disclaimer, the term of this patent is extended or adjusted under 35 U.S.C. 154(b) by 281 days.

(21) Appl. No.: 11/854,709

(22) Filed: Sep. 13, 2007

(65) Prior Publication Data

US 2009/0050837 A1 Feb. 26, 2009

(30) Foreign Application Priority Data

Aug. 23, 2007 (KR) ..... 10-2007-0084894

(51) Int. Cl.
*F16K 27/00* (2006.01)

(52) U.S. Cl. ..... 251/333; 251/366; 206/524.8

(58) Field of Classification Search ..... 251/333, 251/339, 366; 206/524.8; 383/100, 103
See application file for complete search history.

(56) References Cited

U.S. PATENT DOCUMENTS 6,712,334 B2 * 3/2004 Motonaka et al. ..... 206/524.8
7,055,794 B1 * 6/2006 Tang ..... 251/82
2004/0232368 A1 * 11/2004 Motonaka et al. ..... 251/100
2006/0118744 A1 * 6/2006 Tang ..... 251/82
2007/0068841 A1 * 3/2007 Tanaka ..... 206/524.8
2007/0095403 A1 * 5/2007 Su ..... 137/512.15

* cited by examiner

*Primary Examiner*—John Bastianelli
(74) *Attorney, Agent, or Firm*—Ladas and Parry LLP

(57) ABSTRACT

An air discharge valve for a bedclothes compressing-and-storing bag includes a lower main body having an air passage and a packing-receiving groove. An upper body is coupled to the lower main body to define an internal space. The upper body has a plurality of air discharge holes and a central guide opening. A valve body positioned in the internal space and slidably inserted into the guide opening of the upper body for movement between an open position and a closed position. A packing is fitted to the packing-receiving groove of the lower main body, the packing provided with an outer flange portion and an inner flange portion. A top cover is fitted to the valve body for movement together with the valve body, the top cover shaped and sized to close off the air discharge holes of the upper body when the valve body is in the closed position.

4 Claims, 7 Drawing Sheets

AIR DISCHARGE VALVE FOR A BEDCLOTHES COMPRESSING-AND-STORING BAG

FIELD OF THE INVENTION

The present invention relates to an air discharge valve for a bedclothes compressing-and-storing bag and, more specifically, to an air discharge valve for a bedclothes compressing-and-storing bag that can be used in discharging an air from the bag to reduce the volume thereof and in preventing entry of the air into the bag to protect bedclothes from moisture, mold or the like.

BACKGROUND OF THE INVENTION

In general, bedclothes refer to the bedding that contains a wadding material such as cotton, wool, goose feathers, chemical cotton or synthetic fibers. The bedclothes are bulky and quite difficult to transport or store. Furthermore, the wadding material contained in the bedclothes tends to gather moisture and become moldy, thereby giving off offensive smell. This makes it difficult to store and manage the bedclothes.

As a solution to the problems inherent in storage and management of the bedclothes, there has been proposed a bedclothes compressing-and-storing bag that compresses and stores bedclothes in a vacuum state. The bedclothes compressing-and-storing bag includes a collapsible bag body made of a synthetic resin sheet and adapted to receive bedclothes or garment and an air discharge valve attached to the bag body and used in discharging an air from the bag body.

With the bedclothes compressing-and-storing bag noted above, bedclothes or garment are received into the bag body. After closing an opening of the bag body, the internally existing air is discharged through the air discharge valve by means of a vacuum cleaner or other evacuation devices. Thus the bedclothes or garment are compressed into a reduced volume and isolated from the externally existing air. This allows the bedclothes or garment to be transported and stored with ease, while preventing infiltration of moisture or mold into the bag body.

The role played by the air discharge valve is of paramount importance in the bedclothes compressing-and-storing bag. The present inventor has filed a number of Korean patent and utility model applications regarding air discharge valves designed to readily discharge the air existing in a bag body and also to keep the bag body air-tight.

Korean Utility Model Registration No. 20-414999 discloses an air discharge valve as shown in FIG. 1. The air discharge valve includes a main body 3 attached to a vacuum storage bag 2, a support plate 4 coupled to the main body 3 and a valve body 6 fitted into an internal space 5 between the main body 3 and the support plate 4. The valve body 6 is vertically moved to open or close an air passage formed in the main body 3. The main body 3 has an annular bottom groove 3*a* opened upwardly and a contact protrusion 3*b* extending upwards within the annular bottom groove 3*a*. The valve body 6 has an O-ring 7 on its lower surface. The O-ring 7 is inserted into the annular bottom groove 3*a* and then is brought into close contact with the contact protrusion 3*b*, thereby providing an air-tight sealing.

With this air discharge valve, the O-ring 7 is moved up and down together with the valve body 6 to open and close the air passage formed in the main body 3. When closing the air passage, the O-ring 7 makes air-tight contact with the side walls of the annular bottom groove 3*a* as well as the contact protrusion 3*b*.

In the air discharge valve set forth above, however, the O-ring 7 makes frictional contact with the main body 3 as it is moved up and down together with the valve body 6. For this reason, the O-ring 7 may possibly be separated and detached from the valve body 6, which in turn may destroy air-tightness.

In an effort to improve such a problem, Korean Patent No. 10-684669 discloses an air discharge valve as shown in FIG. 2. The air discharge valve includes a main body 3 attached to a vacuum storage bag 2, a cover plate 4 coupled to the main body 3 and a valve body 6 fitted into an internal space 5 between the main body 3 and the cover plate 4. The valve body 6 is vertically moved to open or close an air passage formed in the main body 3. The main body 3 has a packing-receiving groove 3-1 formed outwardly and upwardly of the air passage. A packing 8 is inserted into the packing-receiving groove 3-1 and pressed by an inner rim portion 4-1 of the cover plate 4. The valve body 6 has a stepped contact surface 6-1 that makes contact with the upper and inner surfaces of the packing 8 to provide an air-tight sealing.

With this air discharge valve, the packing 8 is fixedly secured between the main body 3 and the cover plate 4, and the valve body 6 is moved up and down with respect to the packing 8 to open and close the air passage formed in the main body 3. This prevents any inadvertent separation and detachment of the packing 8, while assuring improved air-tightness.

In the air discharge valve noted above, however, the inner rim portion 4-1 of the cover plate 4 protrudes into the internal space 5 to press the packing 8 against removal. For this reason, the inner rim portion 4-1 obstructs the flow of air in the internal space 5, consequently reducing the operability of the air discharge valve.

In addition, with the air discharge valve disclosed in the Korean patent, the valve body 6 and the air passage are all exposed to the outside. Since the valve body 6 functions merely to close the air passage, the air discharge valve suffers from reduction in air-tightness. Another problem resides in that foreign materials or moisture are introduced into the air passage, thus leading to damage, malfunction and contamination of the air discharge valve.

SUMMARY OF THE INVENTION

It is an object of the present invention to provide an air discharge valve for a bedclothes compressing-and-storing bag capable of solving the above-noted and other problems inherent in the prior art.

Another object of the present invention is to provide an air discharge valve for a bedclothes compressing-and-storing bag that can improve the shape and attachment structure of a packing to enhance air-tightness and sealability, while assuring the smooth flow of air through an internal space to maximize the operation efficiency of the air discharge valve.

A further object of the present invention is to provide an air discharge valve for a bedclothes compressing-and-storing bag that has a structure capable of keeping a guide groove and an air passage not exposed to the outside of a cover, thereby improving external appearance of the air discharge valve, preventing any introduction of foreign materials and moisture, prolonging a life span of the air discharge valve and maintaining the air discharge valve clean.

With these objects in view, the present invention provides an air discharge valve for a bedclothes compressing-and-storing bag, including: a lower main body having an air passage and a packing-receiving groove formed upwardly and outwardly of the air passage; an upper body having a plurality of air discharge holes and a central guide opening, the upper body coupled to the lower main body to define an internal space; a valve body positioned in the internal space and slidably inserted into the guide opening of the upper body for movement between an open position in which the air passage of the lower main body gets opened and a closed position in which the air passage of the lower main body is kept closed, the valve body having a horizontal sealing surface and a vertical sealing surface; a packing fitted to the packing-receiving groove of the lower main body, the packing provided with an outer flange portion and an inner flange portion, the outer flange portion gripped by the lower main body and the upper body, the inner flange portion having a horizontal rest surface and a vertical rest surface, the horizontal sealing surface the valve body arranged to make contact with the horizontal rest surface of the packing when the valve body is in the closed position, the vertical sealing surface of the valve body arranged to come into contact with the vertical rest surface of the packing when the valve body is in the closed position; and a top cover fitted to the valve body for movement together with the valve body, the top cover shaped and sized to close off the air discharge holes of the upper body when the valve body is in the closed position.

In the air discharge valve of the present invention, the upper body may have a bottom pressing surface and an annular sealing protrusion formed on the bottom pressing surface to make contact with the outer flange portion of the packing. Furthermore, the valve body may have an annular sealing protrusion formed on the horizontal sealing surface to make contact with the horizontal rest surface of the packing.

In the air discharge valve of the present invention, the upper body may have an outer surface and a plurality of air flow channels formed on the outer surface.

Another object of the present invention is to provide an air discharge valve for a bedclothes compressing-and-storing bag that can improve the shape and attachment structure of a packing to enhance air-tightness and sealability, while assuring the smooth flow of air through an internal space to maximize the operation efficiency of the air discharge valve.

BRIEF DESCRIPTION OF THE DRAWINGS

The above and other objects and features of the present invention will become apparent from the following description of a preferred embodiment, given in conjunction with the accompanying drawings, in which.

DETAILED DESCRIPTION OF THE PREFERRED EMBODIMENTS

Figure 1:
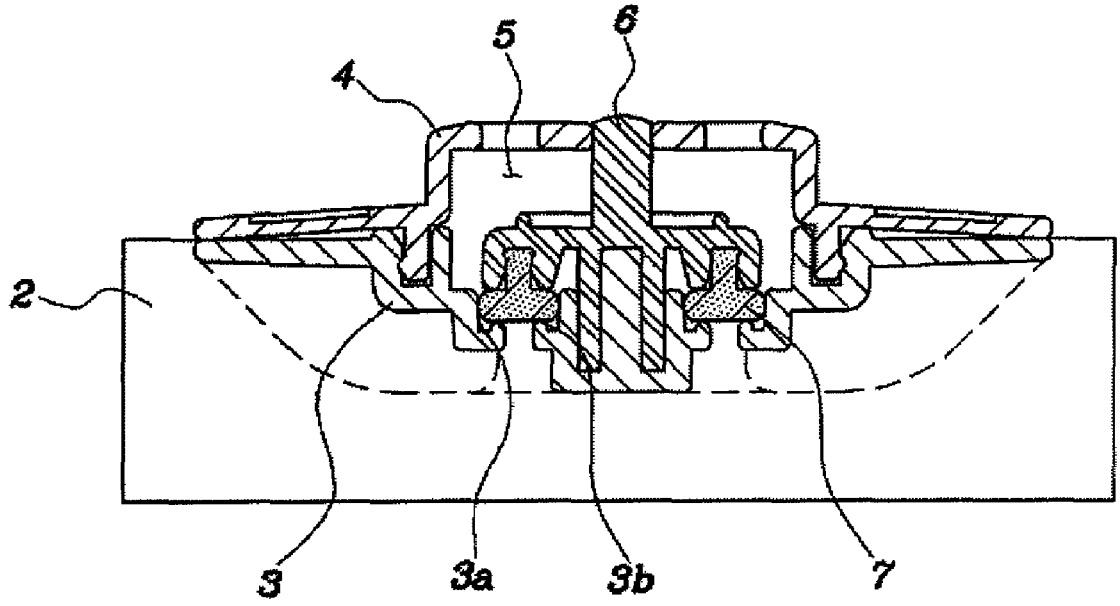
Fig. 1 PRIOR ART
FIG. 1 is a section view illustrating one example of a prior art air discharge valve for a bedclothes compressing-and-storing bag.
Figure 2:
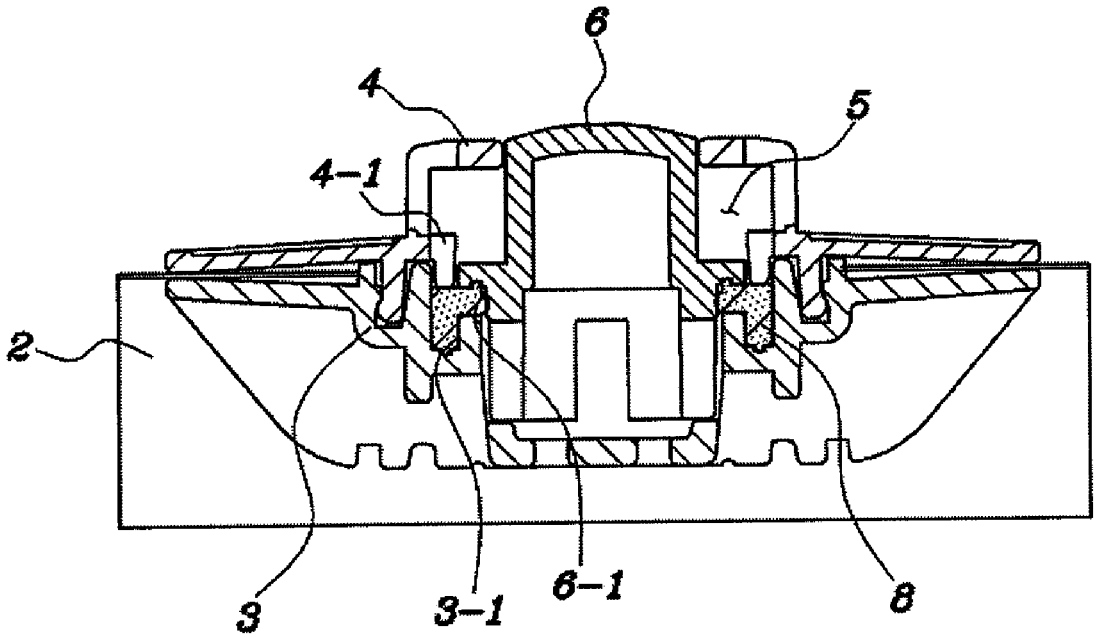
Fig. 2 PRIOR ART
FIG. 2 is a section view illustrating another example of a prior art air discharge valve for a bedclothes compressing-and-storing bag.
Figure 3:
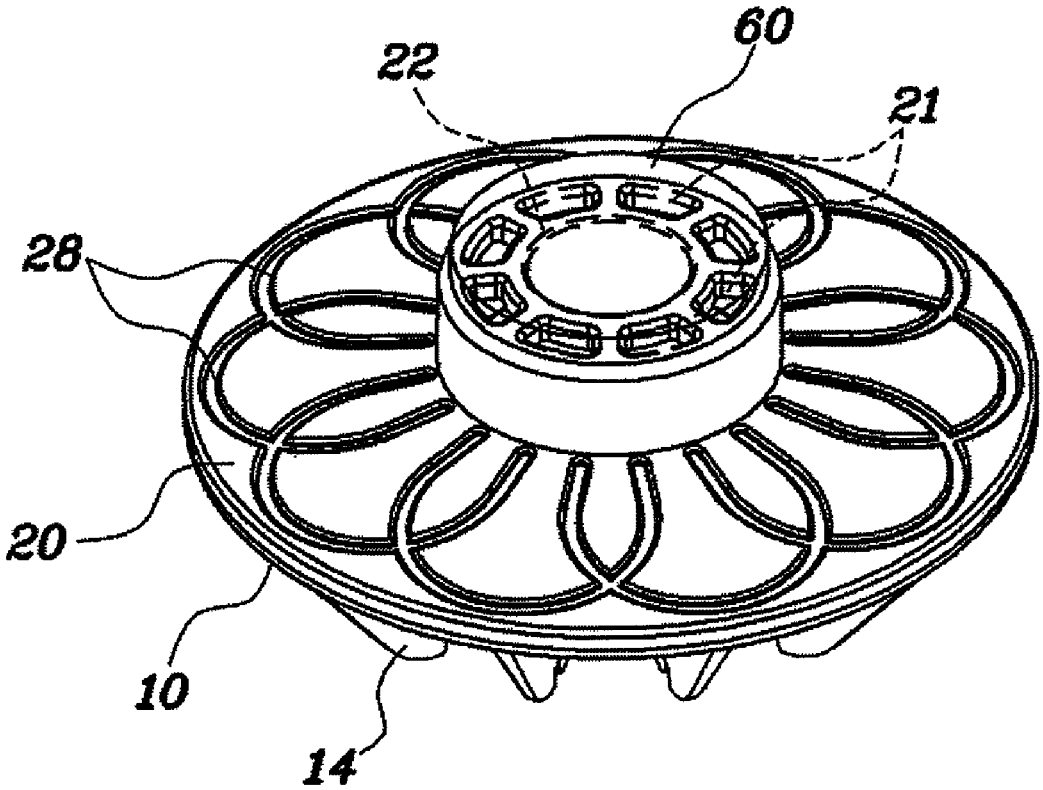
FIG. 3 is a perspective view showing an air discharge valve for a bedclothes compressing-and-storing bag in accordance with the present invention.
Figure 4:
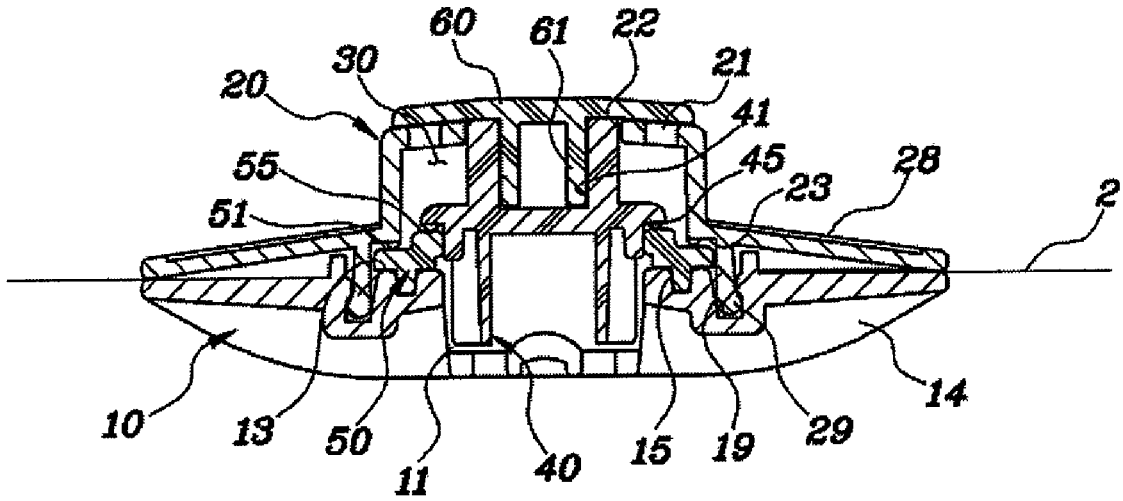
FIG. 4 is a section view of the present air discharge valve shown in FIG. 3.

One preferred embodiment of an air discharge valve for a bedclothes compressing-and-storing bag in accordance with the present invention will now be described in detail with reference to the accompanying drawings.

As shown in FIGS. 3 to 6, an air discharge valve for a bedclothes compressing-and-storing bag in accordance with the present invention includes a lower main body 10 having an air passage 11, an upper body 20 having a plurality of air discharge holes 21 and a central guide opening 22, the upper body 20 removably coupled to the lower main body 10 to define an internal space 30, a valve body 40 inserted into the internal space 30 for movement in a vertical direction, and a rubber-made packing 50 installed between the lower main body 10 and the upper body 20. The valve body 40 is slidably inserted to the guide opening 22 at its top portion and makes close contact with the packing 50 at its bottom portion to air-tightly close the air passage 11 of the lower main body 10.

Figure 5:
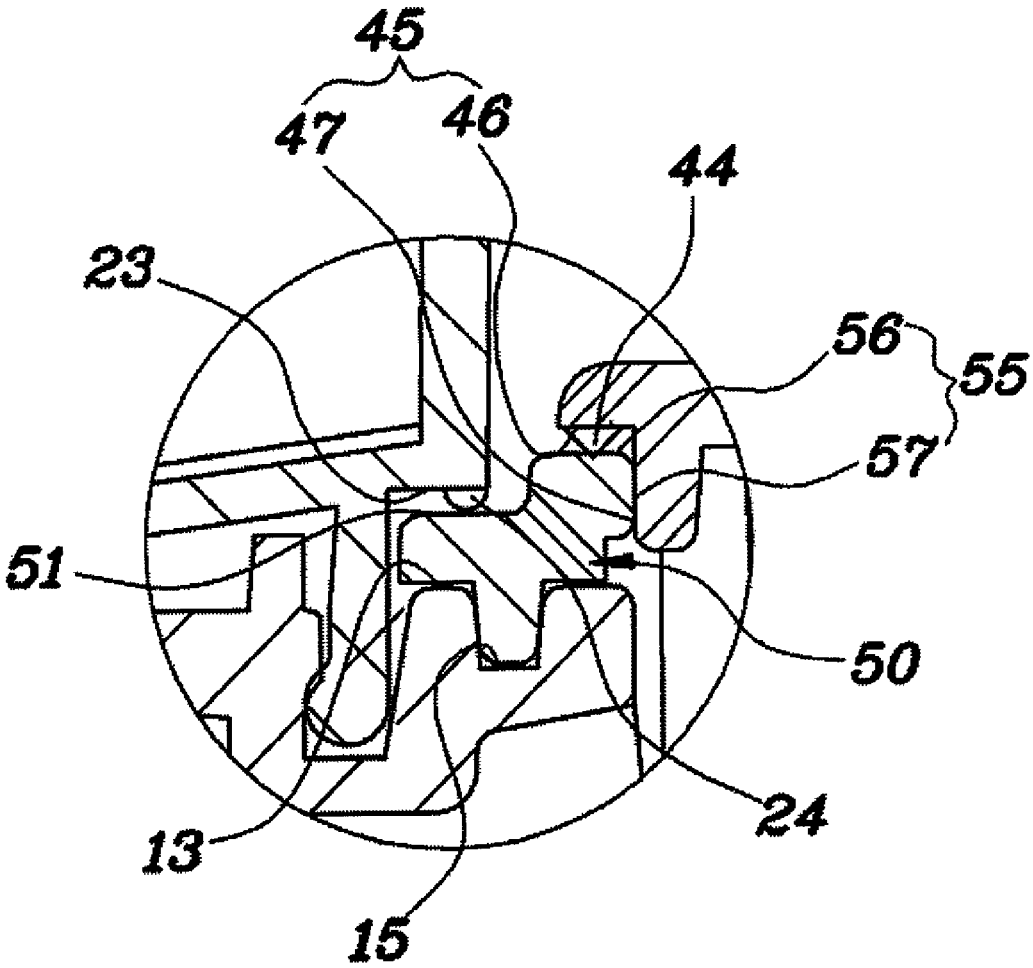
FIG. 5 is an enlarged view showing major parts of the present air discharge valve shown in FIG. 4.
Figure 6:
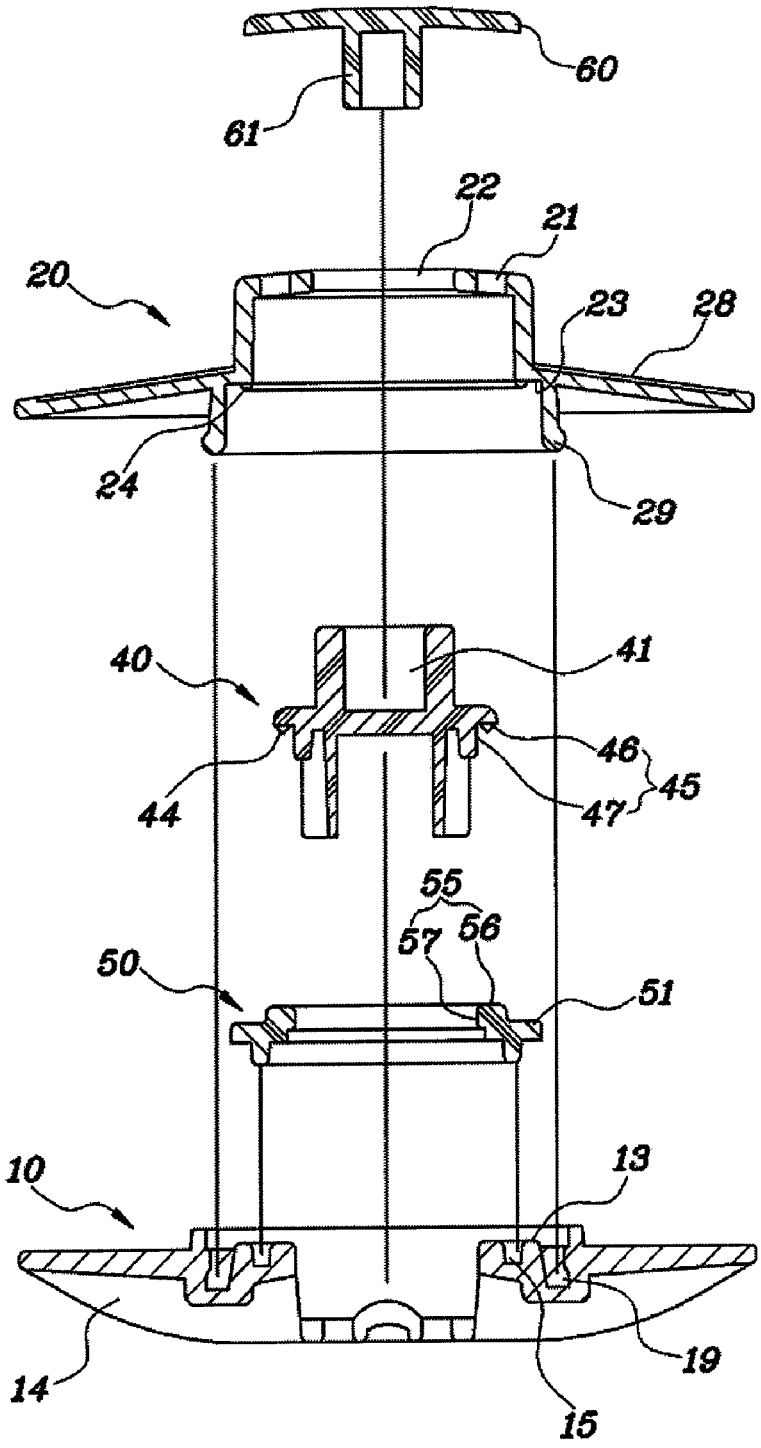
FIG. 6 is an exploded section view of the air discharge valve in accordance with the present invention.

The lower main body 10 has a packing-receiving groove 15 formed upwardly and outwardly of the air passage 11. The packing 50 is fitted to the packing-receiving groove 15 and is provided with an outer flange portion 51 and an inner flange portion 55. The outer flange portion 51 of the packing 50 is gripped by a top pressing surface 13 of the lower main body 10 and a bottom pressing surface 23 of the upper body 20. As best shown in FIG. 5, the inner flange portion 55 of the packing 50 has a horizontal rest surface 56 and a vertical rest surface 57. The valve body 40 is provided with a sealing contact portion 45 having a horizontal sealing surface 46 and a vertical sealing surface 47. When the valve body 40 is in a closed position, the horizontal sealing surface 46 makes contact with the horizontal rest surface 56 of the packing 50 and the vertical sealing surface 47 comes into contact with the vertical rest surface 57 of the packing 50, thereby air-tightly closing the air passage 11.

A top cover 60 is removably fitted to the top end portion of the valve body 40 so that it can close off the guide opening 22 and the air discharge holes 21 of the upper body 20.

An annular sealing protrusion 24 is formed on the bottom pressing surface 23 of the upper body 20 and an annular sealing protrusion 44 is formed on the horizontal sealing surface 46 of the valve body 40. These annular sealing protrusions 24 and 44 make close contact with the packing 50 to provide air-tight sealing.

A plurality of air flow channels 28 are formed on an outer surface of the upper body 20 so that an air can be introduced through the air flow channels 28 when a suction mouth of an evacuation device is pressed against the upper body 20 and a vacuum pressure is applied to the upper body 20 to pull the valve body 40 into an open position. A household vacuum cleaner may be used as the evacuation device. If an environmental air pressure drops by the suction operation of the evacuation device, the valve body 40 is pulled upwardly into the open position. If the evacuation device stops the suction operation, the valve body 40 is returned back to the closed position by the vacuum pressure developed in the bedclothes compressing-and-storing bag 2.

Furthermore, the valve body 40 has a blind bore 41 formed at its upper portion and the top cover 60 has a boss 61 protruding downwardly. The boss 61 of the top cover 60 is snugly fitted to the blind bore 41 of the valve body 40 so that the top cover 60 can move together with the valve body 40.

In addition to the above, the lower main body 10 has a plurality of reinforcing ribs 14 and a coupling groove 19. The upper body 20 has a coupling protrusion 29 forcedly fitted to the coupling groove 19 of the lower main body 10.

Description will now be made on the operation of the air discharge valve set forth above.

Figure 7:
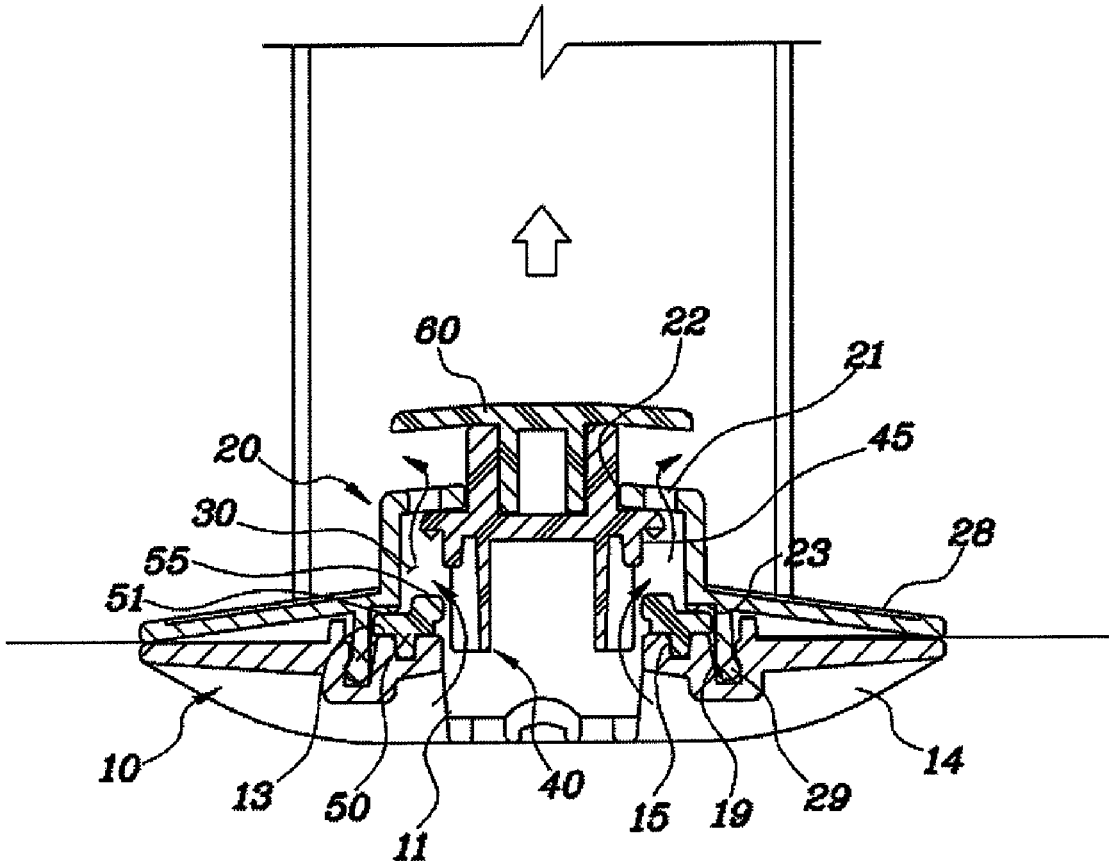
FIG. 7 is a section view illustrating an opened state of the present air discharge valve.

First, bedclothes or garment to be stored are put into the bedclothes compressing-and-storing bag 2 and then the bag 2 is closed against any air leakage. In this state, a suction mouth of an evacuation device is brought into contact with the upper surface of the upper body 20. If the evacuation device starts a suction operation, the valve body 40 is pulled upwardly as shown in FIG. 7.

More specifically, if the suction mouth of the evacuation device is brought into contact with the upper surface of the upper body 20 and if the evacuation device starts a suction operation, an air is introduced into the suction mouth through the air flow channels 28 of the upper body 20, in which process the pressure near the valve body 40 is reduced and hence the valve body 40 is pulled upwardly into an open position.

As the valve body 40 is pulled up in this manner, the horizontal sealing surface 46 and the vertical sealing surface 47 of the valve body 40 are separated from the horizontal rest surface 56 and the vertical rest surface 57 of the packing 50, thereby opening the air passage 11 of the lower main body 10. In other words, the air passage 11 of the lower main body 10 is opened by the upward movement of the valve body 40 and, at the same time, the air discharge holes 21 of the upper body 20 is opened as the top cover 60 is moved upwards together with the valve body 40.

In a state that the air passage 11 of the lower main body 10 and the air discharge holes 21 of the upper body 20 are kept opened, the air existing within the bedclothes compressing-and-storing bag 2 is sucked up and discharged to the outside through the air passage 11, the internal space 30 and the air discharge holes 21.

During this air discharge process, the outer flange portion 51 of the packing 50 is firmly gripped by the top pressing surface 13 of the lower main body 10 and the bottom pressing surface 23 of the upper body 20. Unlike the conventional air discharge valves described earlier, the packing 50 does not overly protrude into the internal space 30 and therefore does not protrude the flow of air. Thus the air existing within the bag 2 is smoothly discharged to the outside.

Once the air existing within the bag 2 has been discharged for the most parts and the bedclothes or garment have been fully compressed, the suction mouth of the evacuation device is detached from the upper body 20 to stop the suction operation. At this time, the air introduced through the air flow channels 28 of the upper body 20 assists in detaching the suction mouth of the evacuation device from the upper body 20.

As soon as the suction operation of the evacuation device is stopped, the valve body 40 is returned back to an original closed position under the action of a vacuum pressure caused by the difference between the external pressure and the internal pressure of the bag 2.

Upon downward movement of the valve body 40, the horizontal sealing surface 46 and the vertical sealing surface 47 of the valve body 40 are brought into contact with the horizontal rest surface 56 and the vertical rest surface 57 of the packing 50, thereby air-tightly closing the air passage 11 of the lower main body 10. In particular, air-tight sealing is assured because the annular sealing protrusion formed on the horizontal sealing surface 46 of the valve body 40 is pressed against the horizontal rest surface 56 of the packing 50.

Simultaneously with the downward movement of the valve body 40, the top cover 60 fitted to the valve body 40 is also moved downwards to close off the air discharge holes 21 and the central guide opening 22 of the upper body 20.

When the valve body 40 is in the closed position, the air discharge holes 21 and the internal space 30 are kept from being exposed to the outside. This prevents any introduction of foreign materials or moisture into the air discharge valve, while providing improved sealing effect.

The embodiment illustrated and set forth hereinabove has been presented for illustrative purpose only and, therefore, the present invention is not limited to this embodiment. It will be understood by those skilled in the art that various changes and modifications may be made without departing from the scope of the invention defined in the claims.

What is claimed is:

1. An air discharge valve for a bedclothes compressing-and-storing bag, comprising:

a lower main body having an air passage and a packing-receiving groove formed upwardly and outwardly of the air passage;

an upper body having a plurality of air discharge holes and a central guide opening, the upper body coupled to the lower main body to define an internal space;

a valve body positioned in the internal space and slidably inserted into the guide opening of the upper body for movement between an open position in which the air passage of the lower main body gets opened and a closed position in which the air passage of the lower main body is kept closed, the valve body having a horizontal sealing surface and a vertical sealing surface;

a packing fitted to the packing-receiving groove of the lower main body, the packing provided with an outer flange portion and an inner flange portion, the outer flange portion gripped by the lower main body and the upper body, the inner flange portion having a horizontal rest surface and a vertical rest surface, the horizontal sealing surface the valve body arranged to make contact with the horizontal rest surface of the packing when the valve body is in the closed position, the vertical sealing surface of the valve body arranged to come into contact with the vertical rest surface of the packing when the valve body is in the closed position; and a top cover fitted to the valve body for movement together with the valve body, the top cover shaped and sized to close off the air discharge holes of the upper body when the valve body is in the closed position.

2. The air discharge valve as recited in claim 1, wherein the upper body has a bottom pressing surface and an annular sealing protrusion formed on the bottom pressing surface to make contact with the outer flange portion of the packing and wherein the valve body has an annular sealing protrusion formed on the horizontal sealing surface to make contact with the horizontal rest surface of the packing.

3. The air discharge valve as recited in claim 1, wherein the upper body has an outer surface and a plurality of air flow channels formed on the outer surface.

4. The air discharge valve as recited in claim 2, wherein the upper body has an outer surface and a plurality of air flow channels formed on the outer surface.

* * * * *